US005984007A

United States Patent [19]

Yuan et al.

[11] Patent Number: 5,984,007

[45] Date of Patent: Nov. 16, 1999

[54] CHIP RESISTANT BUTTONS FOR DOWNHOLE TOOLS HAVING SLIP ELEMENTS

[75] Inventors: Yusheng Yuan, Houston; Douglas W. Davison, Pearland, both of Tex.; Kevin T. Berscheidt, Duncan, Okla.

[73] Assignee: Halliburton Energy Services, Inc., Duncan, Okla.

[21] Appl. No.: 09/005,635

[22] Filed: Jan. 9, 1998

[51] Int. Cl.[6] ..... E21B 23/00

[52] U.S. Cl. ..... 166/134; 166/118; 166/206; 175/423; 188/251 M; 188/67

[58] Field of Search ..... 166/118, 206, 166/134; 188/251 M, 67; 175/423

[56] References Cited

U.S. PATENT DOCUMENTS

| | | | |
|---|---|---|---|
| 3,731,776 | 5/1973 | Fisher | 188/251 M X |
| 4,708,202 | 11/1987 | Sukup et al. | 166/123 |
| 4,730,670 | 3/1988 | Kim | 166/134 |
| 4,808,275 | 2/1989 | Ohzora et al. | 188/251 M X |
| 5,056,630 | 10/1991 | Fujii et al. | 188/24.13 |
| 5,131,468 | 7/1992 | Lane et al. | 166/134 X |
| 5,224,540 | 7/1993 | Streich et al. | 166/118 |
| 5,271,468 | 12/1993 | Streich et al. | 166/387 |
| 5,271,959 | 12/1993 | Hushbeck et al. | 166/184 |
| 5,390,737 | 2/1995 | Jacobi et al. | 166/184 |
| 5,451,084 | 9/1995 | Jansch | 175/423 X |
| 5,540,279 | 7/1996 | Branch et al. | 166/118 |
| 5,701,959 | 12/1997 | Hushbeck et al. | 166/387 |
| 5,878,849 | 3/1999 | Prunier, Jr. et al. | 188/251 M X |

OTHER PUBLICATIONS

Halliburton Services—Sales and Service Catalog No. 43, pp. 2561–2652 and pp. 2556–2557.

International Journal of Self–Propagating High–Temperature Synthesis, vol. 2, No. 3, 1993, pp. 307–313; Paper entitled: Fabrication of Cermets by SHS–QP Method, by Z.Y. Fue et al.

People's Republic of China Patent Application 93107538.6, Filed Jun. 22, 1993; Entitled: Fabrication of Metal–Ceramic Composite Materials By A Self–Propagating High–Temperature Synthesis with Quick Pressing Method; Fu et al.

*Primary Examiner*—David Bagnell
*Assistant Examiner*—Jong-Suk Lee
*Attorney, Agent, or Firm*—Stephen R. Christian

[57] ABSTRACT

A slip element installable about a downhole tool apparatus for use in anchoring a downhole tool in a wellbore. The slip element has at least one slip button made of a metallic-ceramic composite material comprising an effective percentage by weight of a preselected titanium compound. The composite makes the slip button resistant to chipping upon setting but has favorable drillability characteristics upon drilling the downhole tool from a wellbore. The slip element may include at least one slip element made of a non-metallic material such as a laminated nonmetallic composite material. Preferably at least one slip button is made of a metallic-ceramic composite material comprising less than about 75 percent by weight of titanium carbide having a density ranging between about 5 to 7 grams per cubic centimeter. Preferably, the slip button is cylindrically shaped and is installed in at least one slip element at a preselected angle and extends outwardly at a preselected distance from a face of the slip element.

20 Claims, 3 Drawing Sheets

CHIP RESISTANT BUTTONS FOR DOWNHOLE TOOLS HAVING SLIP ELEMENTS

CROSS REFERENCE TO RELATED APPLICATIONS

Not Applicable.

FEDERALLY SPONSORED RESEARCH OR DEVELOPMENT

Not Applicable.

MICROFICHE APPENDIX

Not Applicable.

BACKGROUND OF THE INVENTION

This invention relates generally to downhole tools for use in oil and gas wellbores, and more particularly, to such tools having drillable components made from metallic or non-metallic materials, such as soft steel, cast iron, engineering grade plastics, and composite materials and further having buttons incorporated into anti-slip elements which facilitate the setting and anchoring of downhole tools such as drillable packer and bridge plug tools in wellbores.

In the drilling or reworking of oil wells, a great variety of downhole tools are used. For example, but not by way of limitation, it is often desirable to seal tubing or other pipe in the casing of the well, such as when it is desired to pump cement or other slurry down the tubing and force the slurry out into a formation. It thus becomes necessary to seal the tubing with respect to the well casing and to prevent the fluid pressure of the slurry from lifting the tubing out of the well. Downhole tools referred to as packers and bridge plugs are designed for these general purposes and are well known in the art of producing oil and gas.

The EZ Drill® SV® Squeeze Packer, for example, includes a set ring housing, upper slip wedge, lower slip wedge, and lower slip support made of soft cast iron. These components are mounted on a mandrel made of medium hardness cast iron. The EZ Drill® Squeeze Packer is similarly constructed. The Halliburton EZ Drill® Bridge Plug is also similar, except that it does not provide for fluid flow therethrough.

All of the above-mentioned packers are disclosed in Halliburton Services—Sales and Service Catalog No. 43, pages 2561–2562, and the bridge plug is disclosed in the same catalog on pages 2556–2557.

The EZ Drill® Packer and the EZ Drill® Bridge Plug and the EZ Drill® SV® Packer are designed for fast removal from the well bore by either rotary, cable tool, or coiled tubing drilling methods. Many of the components in these drillable packing devices are locked together to prevent their spinning while being drilled, and the harder slips are grooved so that they will be broken up in small pieces. Typically, standard "tri-cone" rotary drill bits are used which are rotated at speeds of about 75 to about 120 rpm. A load of about 5,000 to about 7,000 pounds of weight is applied to the bit for initial drilling and increased as necessary to drill out the remainder of the packer or bridge plug, depending upon its size. Drill collars may be used as required for weight and bit stabilization.

Such drillable devices have worked well and provide improved operating performance at relatively high temperatures and pressures. The packers and bridge plugs mentioned above are designed to withstand pressures of about 10,000 psi (700 Kg/cm$^2$) and temperatures of about 425° F. (220° C.) after being set in the well bore. Such pressures and temperatures require using the cast iron components previously discussed.

In order to overcome the above long standing problems, the assignee of the present invention introduced to the industry a line of drillable packers and bridge plugs currently marketed by the assignee under the trademark FAS DRILL®. The FAS DRILL® line of tools consist of a majority of the components being made of non-metallic engineering grade plastics to greatly improve the drillability of such downhole tools. The FAS DRILL® line of tools have been very successful and a number of U.S. patents have been issued to the assignee of the present invention, including U.S. Pat. No. 5,271,468 to Streich et al., U.S. Pat. No. 5,224,540 to Streich et al., U.S. Pat. No. 5,390,737 to Jacobi et al., U.S. Pat. No. 5,540,279 to Branch et al., U.S. Pat. No. 5,701,959, Hushbeck et al., and pending U.S. patent application Ser. No. 08/888,719 filed Jul. 7, 1997, to Yuan et al. The preceding patents are specifically incorporated herein.

The tools described in the above references typically make use of metallic or non-metallic slip-elements, or slips, that are initially retained in close proximity to the mandrel but are forced outwardly away from the mandrel of the tool upon the tool being set to engage a casing previously installed within an open wellbore. Upon the tool being positioned at the desired depth, or position, the slips are forced outwardly against the inside of the casing to secure the packer, or bridge plug as the case may be, so that the tool will not move relative to the casing when for example operations are being conducted for tests, to stimulate production of the well, or to plug all or a portion of the well.

It is known within the art that cylindrically shaped inserts, or buttons, may be placed in such slip elements, especially when such slip elements are made of a non-metallic material such as plastic composite material, to enhance the ability of the slip elements to engage the well casing. The buttons must be of sufficient hardness to be able to partially penetrate, or bite into, the surface of the well casing which is typically steel. However, especially in the case of downhole tools being constructed of materials that lend themselves to being easily drilled from the wellbore once a given operation involving the tool has been performed, the buttons must not be so hard or so tough to resist drilling or fouling of the cutting surfaces of the drilling bit or milling bit.

Currently, it is known that buttons made of zirconia ceramic materials offer to a certain extent, the desirable characteristics of being of a sufficient hardness to bite in the casing upon setting the tool, but are not so tough as not to be drillable when it comes time to remove the tool from the wellbore. However, it has become evident that the first portion of the button to contact the casing which is usually the most protruding or leading edge of the cylindrically shaped buttons made of such zirconia ceramic materials are brittle and therefore prone, if not expected, to chip or fracture as the slip element engages with the well casing. Many times, such chipping along the leading edge does not degrade the anti-slipping ability of the tool to a level that the tool actually slips in the casing under normal conditions. However, under extremely high pressures or temperatures the undesired chipping could adversely affect the anti-slip performance of the slip elements because the button would not be able to bite as deeply into the casing as would be possible if the leading edge were not chipped during the setting of the tool.

In order to remedy the problematic chipping characteristic associated with zirconia ceramic buttons, tungsten-carbide material from Retco Tool Co. has been used to form buttons. The tungsten carbide buttons offer enhanced anti-chipping characteristics but do so at the expense of not being as easy to drill or mill as the zirconia buttons when destructively removing the tool from the cased wellbore due to the extreme hardness, higher density, and toughness of the tungsten carbide buttons. Such drilling and milling problems include the tungsten carbide buttons fouling, dulling, difficulty in circulating pieces of the buttons within fluids that may be present in the well bore, and the tungsten carbide buttons simply resisting the cutting edges of the drilling or milling tools. Such resistance causes increased costs associated with the rig and tool crews having to expend more time to manipulate the drill string in order to successfully drill, or mill, the tool from the wellbore.

Thus, there remains a need in the art to identify slip button materials that are sufficiently hard to resist chipping upon biting into the wellbore casing yet not be so tough as to unduly resist drilling or milling when it comes time for the tool having such buttons to be destructively removed from the wellbore casing.

There also remains a standing need in the art to identify cost effective technically suitable slip button materials that are able to withstand the various chemicals, temperatures, mechanical loadings, and pressures encountered in downhole environments.

SUMMARY OF THE INVENTION

A slip means installable about a downhole tool apparatus for use in anchoring a downhole tool in a wellbore comprising slip means being disposable about a downhole tool for grippingly engaging a wellbore when set into position and the slip means having at least one slip button made of a metallic-ceramic composite material comprising an effective percentage by weight of a preselected titanium compound whereby the slip button is resistant to chipping upon setting yet has favorable drillability characteristics upon drilling the downhole tool from a wellbore.

The slip means may include at least one slip element made of a non-metallic material such as a laminated non-metallic composite material. Preferably at least one slip button is made of a metallic-ceramic composite material comprising less than about 75% by weight of titanium carbide. More particularly, at least one slip button is made of a metallic-ceramic composite material comprising: less than about 75% by weight of titanium carbide; less than about 50% by weight of nickel; and less than about 25% by weight of molybdenum.

Furthermore, at least one slip button is cylindrically shaped and is installed in at least one slip means at a preselected angle and extends outwardly at a preselected distance from a face of the slip means.

Furthermore, it is preferred that at least one slip button has a density ranging from about 5 to 7 grams per cubic centimeter.

Additional objects and advantages of the invention will become apparent as the following detailed description of the preferred embodiment is read in conjunction with the drawings which illustrate the preferred embodiment of the present invention.

DETAILED DESCRIPTION OF THE INVENTION

Figure 1:
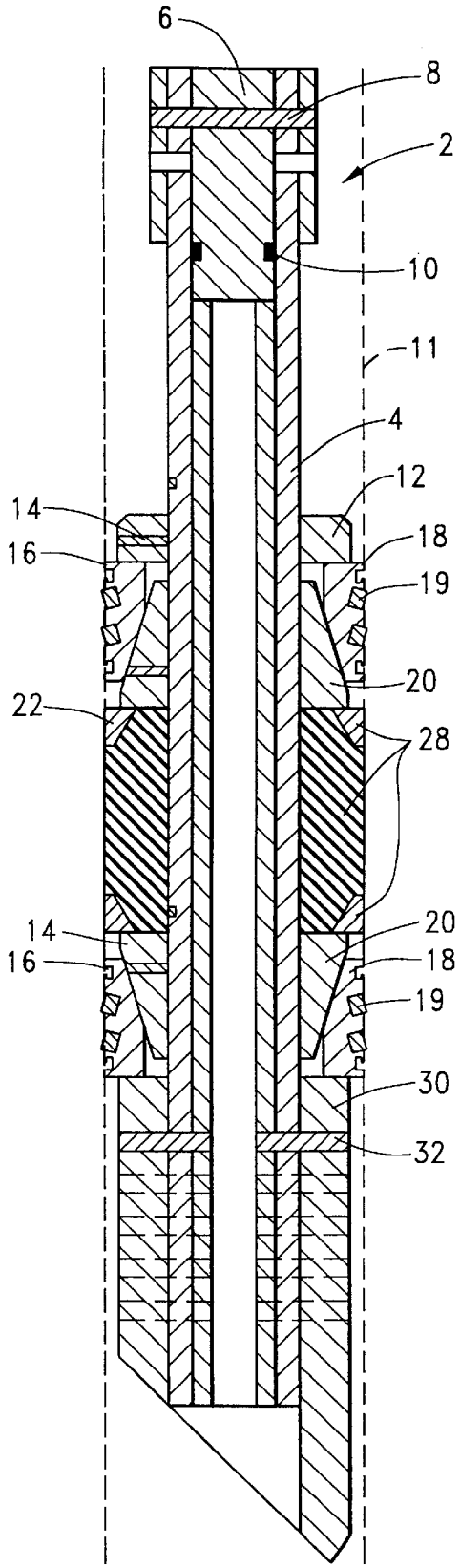
FIG. 1 is an exemplary downhole tool having slip element buttons embodying the present invention.

Referring now to the drawings, FIG. 1 shows the slip retention system of the present invention being used on a downhole tool representative of one well known in the art. A description of the general workings of the tool and associated slips will be followed by the description of the present invention as the present invention is very adaptable to all tools using slip elements to resist tool slippage.

FIG. 1 is cross sectional view of a representative downhole tool 2 having a mandrel 4. The particular tool of FIG. 1 is referred to as a bridge plug due to the tool having an optional plug 6 being pinned within mandrel 4 by radially oriented pins 8. Plug 6 has a seal means 10 located between plug 6 and the internal diameter of mandrel 4 to prevent fluid flow therebetween. By not incorporating plug 6, the overall tool structure would be suitable for use as, and referred to as a packer, which typically have at least one means for allowing fluid communication through the tool. Packers therefore allow for the controlling or throttling fluid passage through the tool by incorporating one or more valve mechanisms which may be integral to the packer body or which may be externally attached to the packer body. Such valve mechanisms are not shown in the drawings of the present document. The representative tool may be deployed in wellbores having casings 11 or other such annular structure or geometry in which the tool may be set.

Packer tool 2 includes the usage of a spacer ring 12 which is preferably secured to mandrel 4 by pins 14. Spacer ring 12 provides an abutment which serves to axially retain slip segments 18 which are positioned circumferentially about mandrel 4. Preferably each slip segment 18 has inserted a plurality of buttons 19 of the present invention installed and protruding from the face of slip segments 18. Slip retaining bands 16 serve to radially retain slips 18 in an initial circumferential position about mandrel 4 as well as slip wedge 20. Bands 16 are made of a steel wire, a plastic material, or a composite material having the requisite characteristics of having sufficient strength to hold the slips in place while running the tool downhole and prior to actually setting the tool in casing yet be easily drillable when the tool is to be removed from the wellbore. Preferably bands 16 are inexpensive and easily installed about slip segments 18. Slip wedge 20 is initially positioned in a slidable relationship to, and partially underneath slip segments 18 as shown in FIG. 1. Slip wedge 20 is shown pinned into place by pins 22.

Located below slip wedge 20 is at least one packer element, and as shown in FIG. 1, a packer element assembly 28. At both ends of packer element assembly 28 are packer shoes 29 which provide axial support to respective ends of packer seal element assembly 28. The particular packer seal element arrangement show in FIG. 1 is merely representative as there are several packer element arrangements known and used within the art.

Located below lower slip wedge 20 are a plurality of multiple slip segments 18 having inserted buttons 19 of the present invention. Slip segments 18 preferably have at least one retaining band 16 secured thereabout as described earlier.

At the lowermost terminating portion of tool 2 referenced as numeral 30 is an angled portion referred to as a mule-shoe which is secured to mandrel 4 by radially oriented pins 32. However lowermost portion 30 need not be a mule shoe but could be any type of section which serves to terminate the structure of the tool or serves to be a connector for connecting the tool with other tools, a valve, or tubing etc. It is appreciated by those in the art, that pins 8, 14, 16, 22, and 32, if used at all as respective components may be bonded together with preselected adhesives, are preselected to have shear strengths that allow for the tool be set and to be deployed and to withstand the forces expected to be encountered in a wellbore during the operation of the tool, which such operation of the tool is well known in the art and is also described in the references cited herein.

It is not necessary to have the particular slip segment and slip wedge construction shown in FIGS. 1–5 in order to practice the present invention, as the present invention can be used in connection with any type of downhole tool employing slips that are forced outwardly away from the tool. Furthermore, it does not matter whether the tool is made essentially of only metallic components, essentially of non-metallic components, or a combination of both metallic and non-metallic components, only that the slip elements employ at least one button of any size or geometrical configuration.

Figure 2:
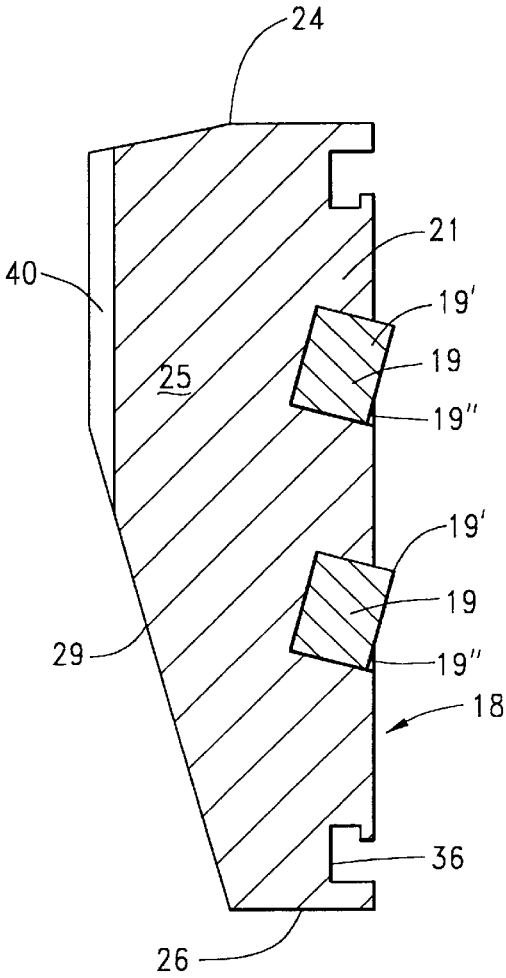
FIG. 2 is an enlarged cross-sectional side view of an exemplary slip element having buttons embodying the present invention as taken along line 2/3 shown in FIG. 4.
Figure 3:
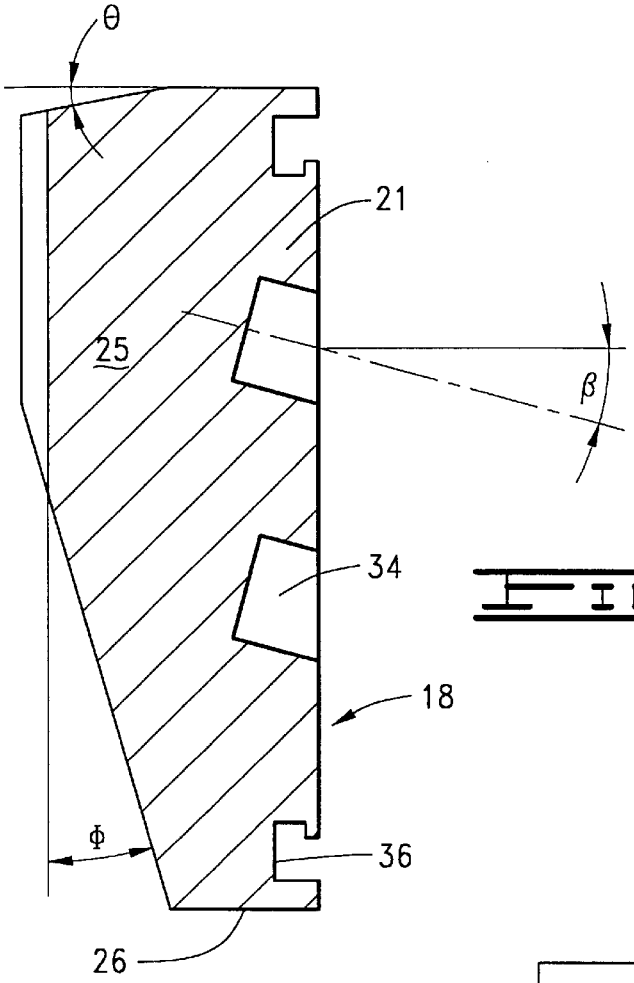
FIG. 3 is a cross-sectional side view of an exemplary slip element as shown in FIG. 2 as taken along line 2/3 of FIG. 4 with the subject buttons removed and further depicts the preferred angle in which the buttons are positioned.

Slip segment 18 as shown in the cross-sectional views of FIGS. 2 and 3, has an outer external face 21 having a plurality of insert buttons 19 extending outwardly therefrom that are secured within cavities 34 by being molded into, or otherwise secured therein. Insert buttons 19 of the present invention are preferably made of a metallic composite ceramic that includes a preselected percentage of titanium carbide, nickel, and molybdenum available from General Plastics and Rubber Company, Inc., 5727 Ledbetter, Houston, Tex., U.S.A., 77087-4095 and are referred to as MCC buttons. Preferably, the metallic composite ceramic material includes, but is not limited to, having preselected amounts of titanium carbide, tungsten carbide, nickel, and molybdenum. More particularly, on an elemental percentage basis, it is preferred that buttons 19 have a titanium carbide content of less than about 75%, a nominal amount of tungsten carbide, a content of less than about 50% nickel, and a content of less than about 20% molybdenum.

Furthermore, the material density of the metallic composite buttons 19 disclosed herein ranges between 5 to 7 grams per cubic centimeter.

It has been discovered that by using slip buttons 19 as taught herein, leading edge 19', or the biting edge, of slip button 19 is very resistant to chipping during the initial positioning and final setting of the tool against a casing, or annular structure. By resisting such chipping, the inserted slip button provides a better bite into the casing, or structure, to better hold the tool therein under higher working pressures and temperatures than priorly known slip buttons that are able to be drilled or milled with relative ease. That is the buttons taught herein significantly advance the art because the subject buttons are better able to bite into a casing without being damaged while still maintaining the favorable characteristic of being drillable or millable in a short period of time upon destructively removing the subject tool from a wellbore as compared to priorly known slip insert buttons. Furthermore, due to the lesser density of the buttons taught herein as compared to prior art button materials, the present buttons are more easily circulated away from the drilling or milling bit by the fluid in the wellbore, thereby greatly improving drilling or milling speeds. This button density if especially important when drilling or when lighter density fluids are present in the wellbore, or annular structure, including but not limited to, weighted or unweighted water and nitrogen/water mixture.

Preferably slip button cavities 34 are angled from horizontal approximately 15° but other angles can be used.

Typically slip buttons 19 are from 0.250 (6.3 mm) to 0.375 inches (9.5 mm) in diameter and are from 0.250 inches (6.3 mm) to 0.500 inches (12.5 mm) in length depending on the nominal diameter and working pressures and temperatures of the tool in which the insert buttons are to be used. As can be seen in FIG. 2 it is preferred, but not essential, that button 19 be installed so that leading edge 19' protrudes from face 21 while the opposite trailing edge 19", or recessed edge, be flush or slightly recessed from face 21.

Slip segment elements 18 can be made of a very drillable/millable composite material obtained from General Plastics as referenced herein as well as materials set forth in the present Assignee's patents referenced herein or it can be formed of a metallic material as known within the art. General Plastics, on behalf of the Assignee, secures inserts 19 by adhesives as taught herein within composite elements 18 after drilling cavity 34 in outer face 21, and is a reliable commercial source for such elements using the buttons taught herein. The use of adhesives to secure buttons 19 is recommended but other methods to secure the buttons can be used.

Figure 4:
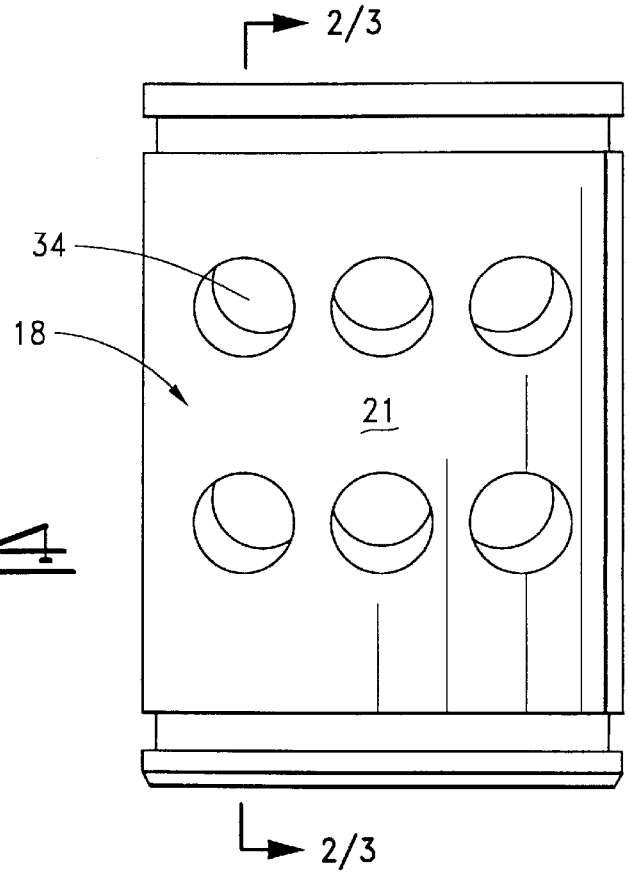
FIG. 4 is a front view of an exemplary slip element shown in FIGS. 1–3 with the buttons or inserts of the present invention removed and further shows the section line and view orientation of FIGS. 2 and 3.

FIG. 2 is a cross-sectional view taken along line 2/3 of slip segment 18 as shown in FIG. 4. Returning to FIG. 2, slip segment 18 has two opposing end sections, abutment-end 24 and free-end 26, and has an arcuate inner slip element surface having topology which is complementary to the outer most surface of mandrel 4. Preferably abutment-end surface 24 is angled approximately 5°, shown in FIG. 3 as angle $\theta$, to facilitate outward movement of the slip when setting the tool. Slip segment bearing surface 29 is flat, or planar, and is specifically designed to have topology matching a complementary surface on slip wedge 20. Preferably bearing surface 29 is inclined from vertical at a preselected angle $\phi$ as shown in FIG. 3. Preferably angle $\phi$ is approximately 18° for a tool made essentially of composite materials for a 7 inch casing, but angle $\phi$ typically ranges between 15° to 20°.

Figure 5:
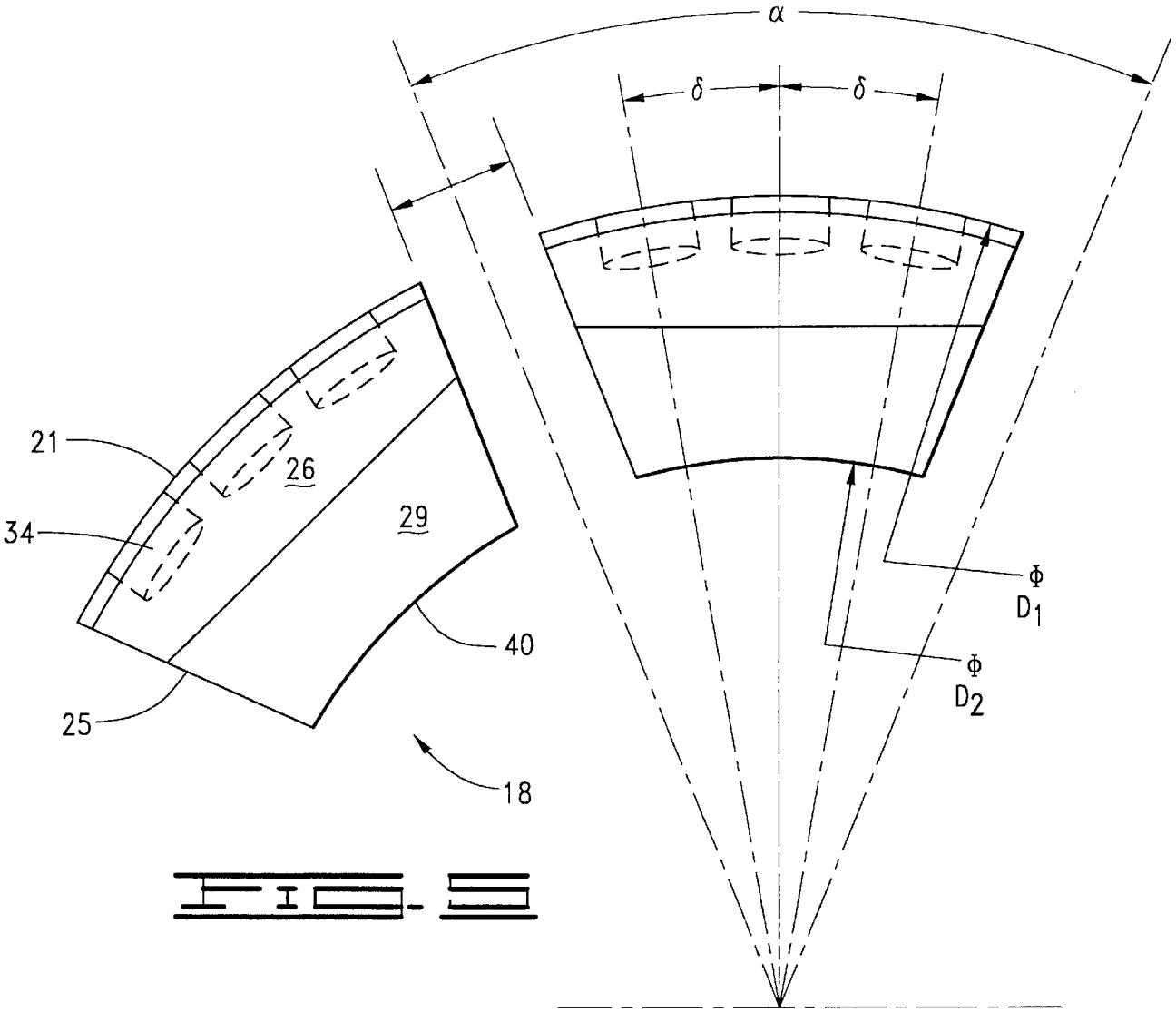
FIG. 5 is an exploded free-end view of two exemplary slip elements having slip buttons of the present invention shown in FIGS. 1–4 and depicts the preferred relative positioning of a plurality of such slip elements about a downhole tool of a preselected size.

Referring to FIG. 5, the location and the radial positioning of sides 25 of slip segments 18 are defined by an angle $\alpha$ which is preselected to achieve an optimal number of segments for a mandrel having an outside diameter of a given size and for the casing or well bore diameter in which the tool is to be set. Angle $\alpha$ is preferably approximately equal to 45° for a tool designed for a 7 inch casing or annular structure. However, an angle of a ranging from 45° to 60° can be used depending on the nominal diameter of the tool being constructed.

Returning to FIG. 5, the sides of slip segments 18 are designated by numeral 25. It is preferred that six to eight segments encircle mandrel 4 and are retained in place prior to setting of the tool by at least one, and preferably two slip retaining means that are accommodated by circumferential grooves 36. Such retaining means may be frangible or elastic as known within the art and taught by the references cited herein. Outside slip diameters D1 and inside slip diameter D2 are based upon the nominal diameter of the tool to be constructed as well as the nominal diameter of the slip wedge having complementary bearing surfaces to bearing surface 29 of slip element 18. For a tool designed for a 7 inch casing or annular structure D1 typically is approximately 6 inches and D2 is approximately 4 inches.

The practical operation of downhole tools embodying the present invention, including the representative tool depicted and described herein, is conventional and thus known in the art as evidenced by prior documents.

Furthermore, although the disclosed invention has been shown and described in detail with respect to the preferred embodiment, it will be understood by those skilled in the art that various changes in the form and detail thereof may be made without departing from the spirit and scope of this invention as claimed.

What is claimed is:

1. A downhole tool apparatus for use in anchoring a downhole tool in a wellbore, comprising:

a) a slip means disposable about the downhole tool for grippingly engaging the wellbore when set into position, the slip means having at least one slip button made of a metallic-ceramic composite material comprising an effective percentage by weight of a preselected titanium compound, whereby the at least one slip button is resistant to chipping upon setting yet has favorable drillability characteristics upon drilling the downhole tool from the wellbore.

2. The apparatus of claim 1 wherein at least a portion of the slip means is made of a non-metallic material.

3. The apparatus of claim 2 wherein the slip means is made of a laminated non-metallic composite material.

4. The apparatus of claim 1 wherein the at least one slip button is made of a metallic-ceramic composite material comprising less than about 75 percent by weight of titanium carbide.

5. The apparatus of claim 1 wherein the at least one slip button is made of a metallic-ceramic composite material comprising less than about 75 percent by weight of titanium carbide; less than about 50 percent by weight of nickel; and less than about 25 percent by weight of molybdenum.

6. The apparatus of claim 1 wherein the at least one slip button is made of a metallic-ceramic composite material comprising at least about 50 percent by weight of titanium carbide.

7. The apparatus of claim 6 wherein the at least one slip button is cylindrically shaped.

8. The apparatus of claim 1 wherein the at least one slip button is made of a metallic-ceramic composite material comprising at least about 40 percent by weight of titanium carbide; at least about 15 percent by weight of nickel; and at least about 5 percent by weight of molybdenum.

9. The apparatus of claim 1 wherein the at least one slip button is installed in the at least one slip means at a preselected angle and extends outwardly at a preselected distance from a face of the slip means.

10. The apparatus of claim 1 wherein the at least one slip button has a density ranging from about 5 to 7 grams per cubic centimeter.

11. An apparatus for anchoring a packer type downhole tool in an annular structure, comprising:

a plurality of primarily non-metallic slip wedge elements sized and configured to be held in an initial position about a mandrel of the tool, at least one of the slip wedge elements having a plurality of metallic ceramic composite slip buttons inserted therein and at least one of the metallic ceramic composite slip buttons being made of a material comprising a titanium compound.

12. The apparatus of claim 11 wherein the at least one of the metallic ceramic composite slip buttons has a density ranging between about 5 to about 7 grams per cubic centimeter.

13. The apparatus of claim 11 wherein the at least one of the metallic ceramic composite slip buttons comprises at least about 40 percent by weight of titanium carbide.

14. The apparatus of claim 11 wherein the at least one of the metallic ceramic composite slip buttons comprises at least about 50 percent by weight of titanium carbide; at least about 20 percent by weight of nickel; and at least about 10 percent by weight of molybdenum.

15. The apparatus of claim 11 wherein the at least one of the metallic composite slip buttons is a cylindrically shaped button angled at a preselected angle and extends outwardly at a preselected distance from a face of the slip means.

16. The apparatus of claim 15 wherein the plurality of metallic composite slip buttons are arranged in a preselected pattern having a preselected spacing between adjacent buttons.

17. A packer tool made essentially of non-metallic composite materials having an apparatus for anchoring the tool in an annular structure, comprising:

a) a central mandrel with a plurality of non-metallic slip element means located circumferentially thereabout;

b) a plurality of slip buttons installed within at least one of the non-metallic slip element means in a preselected pattern and extending outwardly a predetermined amount from an outer face thereof, at least one of the slip buttons being set at a preselected angle with respect to the mandrel, the at least one of the slip buttons being cylindrically shaped, and the at least one of the slip buttons being made of a material comprising a titanium compound.

18. The packer tool of claim 17 wherein the at least one slip button is made of a titanium compound having a density ranging between about 5 to 7 grams per cubic centimeter.

19. The packer tool of claim 17 wherein the at least one slip button is made of a titanium compound comprising at least about 40 percent by weight of titanium carbide.

20. The packer tool of claim 17 wherein the at least one slip button is made of a titanium compound comprising at least about 50 percent by weight of titanium carbide, at least about 20 percent by weight of nickel, and at least about 5–10 percent by weight of molybdenum.

* * * * *